United States Patent [19]

Burger et al.

[11] 3,939,296

[45] Feb. 17, 1976

[54] ANNEALING FURNACE BASE PLATE SUPPORTS

[75] Inventors: John H. Burger; John R. McClelland, both of Butler; Robert P. Dunkle, Kittanning, all of Pa.

[73] Assignee: Armco Steel Corporation, Middletown, Ohio

[22] Filed: Sept. 24, 1974

[21] Appl. No.: 508,698

[52] U.S. Cl. ..... 13/25; 13/20; 432/260

[51] Int. Cl.[2] ..... F27D 3/02; F27D 3/12

[58] Field of Search ..... 13/1, 20, 25, 31; 432/260, 432/254; 266/5 R

[56] References Cited

UNITED STATES PATENTS

| | | | |
|---|---|---|---|
| 3,588,305 | 7/1971 | Seelandt | 13/1 |
| 3,661,371 | 5/1972 | Skelton | 432/260 |
| 3,737,553 | 6/1973 | Kreider | 13/25 |

*Primary Examiner*—R. N. Envall, Jr.

*Attorney, Agent, or Firm*—Melville, Strasser, Foster & Hoffman

[57] ABSTRACT

In an annealing furnace of the type comprising an outer enclosure surrounding an insulated heating chamber and wherein the bottom of the heating chamber comprises a metallic coil carrying car having one or more base plates upon which the coils of metal to be annealed are supported and having electrical heating elements beneath the base plates, improved means for supporting the one or more base plates on the coil carrying car. The support means for each base plate comprises a plurality of refractory blocks mounted on the upper surface of the car and upon which the base plate rests. The refractory blocks are so arranged as to accommodate the heating elements beneath the base plate and to permit the circulation of an atmosphere thereabout, while at the same time affording maximum support for the base plate.

19 Claims, 7 Drawing Figures

ANNEALING FURNACE BASE PLATE SUPPORTS

BACKGROUND OF THE INVENTION

1. Field of the Invention

The invention relates to improved supports for the base plates of an annealing furnace upon which coils to be annealed are placed, and more particularly to such base plate supports for use in annealing furnaces of the type taught in U.S. Pat. No. 3,588,305.

2. Description of the Prior Art

While not intended to be so limited, the base plate supports of the present invention are particularly adapted for use in annealing furnaces of the type taught in U.S. Pat. No. 3,588,305 and, for purposes of an exemplary showing, will be described in association with such an annealing furnace. Annealing furnaces of this type may be used for various purposes. They are well suited, for example, for practicing the final anneal on oriented silicon iron for magnetic uses, during which the desired orientation is achieved. Such furnaces are adapted to operate both under a vacuum and under a desired annealing atmosphere. For an exemplary teaching of a process of annealing oriented silicon iron for magnetic purposes in such furnaces, reference is made to the copending application Ser. No. 609,189, filed Sept. 2, 1975 in the name of the same inventors and entitled A METHOD OF ANNEALING ORIENTED SILICON STEEL.

As will be described more fully hereinafter, the bottom of the heating chamber of a furnace of this type comprises a wheeled car adapted to ride upon rails or other appropriate surfaces. The coils to be annealed may be placed upon the car and the car rolled into the outer shell of the furnace. In general, the car also carries the front insulative wall of the heating chamber within the furnace shell, so that when the car is in position within the furnace shell, it completes the insulative heating chamber, fully enclosing the coils.

Depending upon the size of the furnace, the car bottom of the heating chamber is adapted to carry one or more coils. The upper surface of the car is covered with an appropriate refractory ceramic fiber. Spaced upwardly of the refractory ceramic fiber there is a base plate for each coil, each coil being placed upon its respective base plate. Between the bottom of each base plate and the upper surface of the car there is located an electrical heating element of molybdenum or other appropriate material. This heating element is, itself, appropriately supported on insulative means. When the car is fully located within the furnace outer shell, the heating elements are manually connected to the electrical facilities of the furnace so that they may be turned on and turned off at desired times during the annealing procedure.

Heretofore, the base plates have been supported in horizontal position, spaced upwardly from the refractory ceramic fiber covering the upper surface of the car by a series of approximately nine hollow stainless steel posts. Each post extended up through the refractory ceramic fiber on the car top and had a length of approximately 14 inches, an external diameter of approximately 5 inches and an internal diameter of about 2 inches. The lowermost end of each post was reduced in diameter and adapted to be received in a socket formed on the upper surface of the car. Both the socket bottom and the hollow center of the post were filled with insulative material to prevent the posts and the car to which they were affixed from acting as a heat sink for the base plate.

In recent years it has become the practice to anneal large coils of silicon steel weighing in the neighborhood of from 30,000 to 40,000 pounds. During the annealing process, temperatures of 2,200°F or more are reached. Despite the fact that the base plates comprise disc-like stainless steel or ingot iron members having a thickness of approximately 6 inches and a diameter in excess of 80 inches, it has been found that by virtue of the high temperatures during the annealing procedure and the great weight supported by the base plates, the base plates have shown a tendency to become permanently warped and distorted due to the inadequacy of the prior art support means for them. Distortion and warpage of the base plates has resulted in distortion of the coils mounted on them, seriously impairing the final product.

The present invention is directed to the provision of improved supports for the base plates. While blocks of stainless steel, ingot iron and the like were substituted for the prior art posts, it was found that such blocks would expand during heat-up and would ultimately deform so that they would not contract to their original shape. The present invention is based upon the discovery that support means in the form of blocks of appropriate refractory material would overcome the various problems encountered with the prior art posts, as enumerated above. The refractory blocks of the present invention are so arranged as to provide maximum support for the base plates, while at the same time permitting adequate circulation of atmosphere about the heating elements beneath the base plates.

SUMMARY OF THE INVENTION

The support means of the present invention comprise cast blocks of appropriate refractory material such as alumina. While each support may constitute a single, large cast block, in the embodiment illustrated each support comprises a pair of blocks mounted one on top of the other. When pairs of block are used the lowermost block of each support rests directly on the upper surface of the car. The lower block of each support is of a height less than the height of the refractory ceramic fiber mounted on top of the car and about the supports. The uppermost block of each support may be of the same length and width as the lowermost block it rests upon, or its length and width may be slightly less than the lower block. The upper block is of greater height than the lower block and extends above the top of the car by a distance sufficient to enable the placement of the heating elements below the base plate.

The supports of the present invention extend upwardly between and about the heating elements and their number and arrangement is such as to provide maximum support for the base plates, while permitting adequate circulation of atmosphere about the heating elements. As will be described hereinafter, the arrangement of the supports may be varied, depending upon the arrangement of the heating elements beneath the base plate.

DESCRIPTION OF THE PREFERRED EMBODIMENTS

Figure 1:
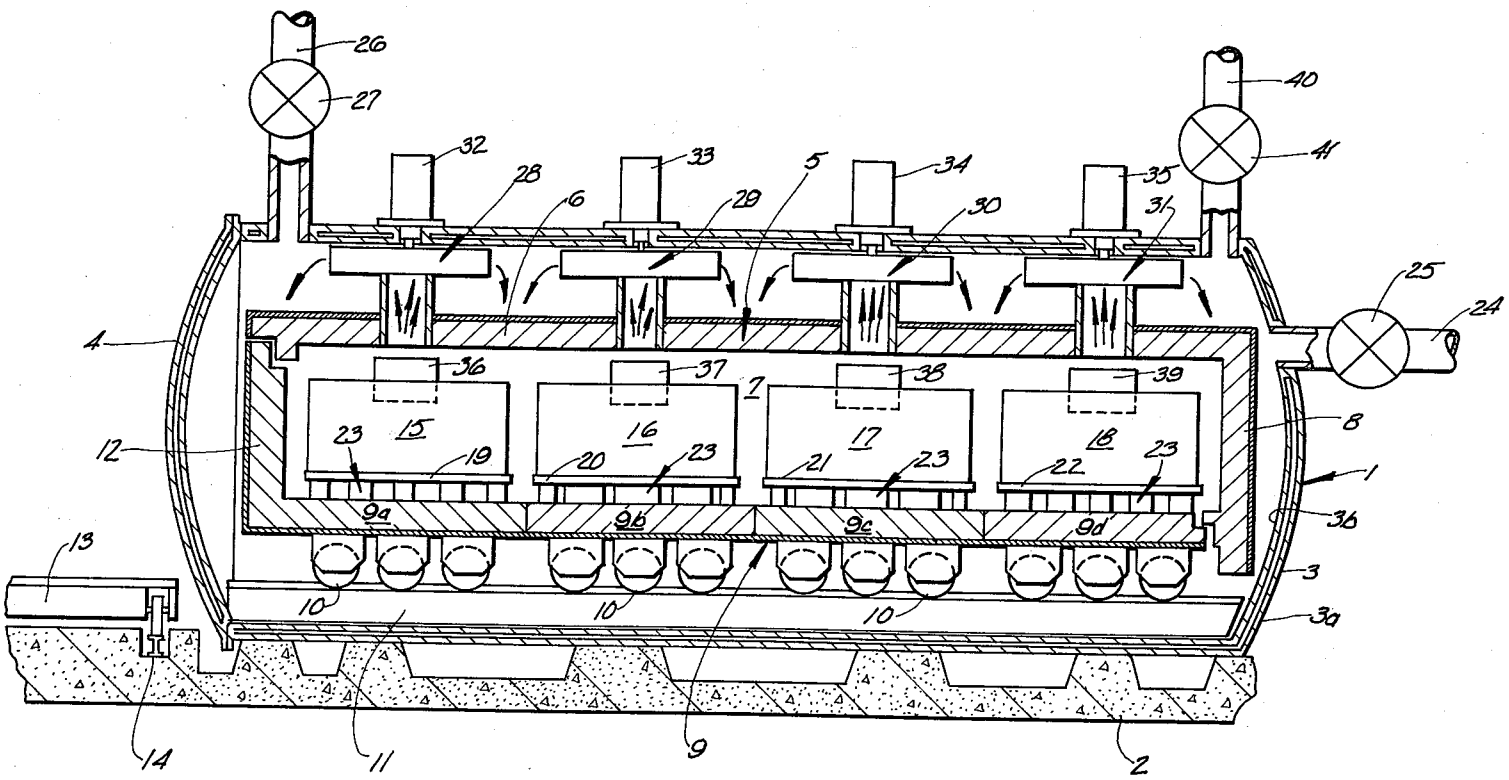
FIG. 1 is a semi-diagramatic elevation view, partly in cross section, of a furnace of the type described in U.S. Pat. No. 3,588,305 provided with the support means of the present invention.

FIG. 1 is a semi-diagramatic representation of a furnace of the type taught in U.S. Pat. No. 3,588,305. In FIG. 1, the furnace is generally indicated at 1 and is shown mounted upon an appropriate foundation 2. The furnace comprises an outer enclosure or shell 3. While not so limited, the enclosure 3 may be made up of an outer wall 3*a* and an inner wall 3*b* so that water may be circulated between the walls to cool and control the temperature of the outer enclosure. When the enclosure is water cooled, appropriate water inlet and outlet means (not shown) will be provided, as is well known in the art. At its forward end, the outer enclosure is provided with door means 4 which may be raised and lowered between open and closed positions by appropriate means (not shown) well known in the art.

Within the enclosure 1 there is a heating chamber generally indicated at 5. The chamber 5 comprises a top wall 6, side walls (one of which is shown at 7) and an end wall 8. This much of the heating chamber is appropriately supported within the furnace enclosure 1 by means not shown. The support means for this portion of the heating chamber may themselves be wheeled and ride upon rails so that the entire chamber may be removed from the enclosure 1 for purposes of repair.

A car, generally indicated at 9, is provided with a plurality of wheels 10 adapted to ride upon rails, one of which ia shown at 11. The car 9 is made up of four sections 9*a* through 9*d*, appropriately hooked together so that the entire car 9 may act as a single unit. The car 9, as will be evident from FIG. 1, constitutes the bottom of heating chamber 5. The forwardmost car section 9*a* carries an upstanding wall 12 which constitutes the forward wall of the heating chamber 5. When the car 9 is fully within the closure 1 it will be noted that it completes the heating chamber. The front wall 12, rear wall 8, top wall 6 and side walls (one of which is shown at 7) of the heating chamber 5 may generally comprise steel plate covered with a layer of any appropriate refractory ceramic fiber, as is well known in the art. The upper surface of car 9 is also covered with an appropriate refractory ceramic fiber. The ceramic fiber used for the walls of the heating chamber and the upper surface of the car does not constitute a limitation of the present invention. Ceramic fiber manufactured under the trademark KAOWOOL by Babcock and Wilcox of Augusta, Ga. has been employed with success.

For purposes of loading and unloading the heating chamber 5, the door means 4 of the outer enclosure 1 can be opened and the car 9 removed from the furnace and located upon a transfer carriage fragmentarily shown at 13. The carriage 13 rides on rails, one of which is shown at 14. The carriage itself is provided with transverse rails adapted to receive the wheels 10 of car 9. The car 9 can then, via transfer carriage 13, be taken to a loading station to receive coils to be annealed or to an unloading station for coils which have been annealed.

In FIG. 1, the car is illustrated as carrying four metallic coils 15 through 18. The coils are mounted upon base plates 19 through 22, respectively. The base plates, themselves, are horizontally oriented and spaced upwardly from the insulative material on the upper surface of car 9 by the support means of the present invention generally indicated at 23.

The interior of the outer enclosure 3 may be connected to an appropriate vacuum source by pipe 24 controlled by valve 25. In this way, the furnace outer enclosure and the heating chamber 5 may be evacuated. Via pipe 26, controlled by valve 27, a desired atmosphere such as hydrogen, nitrogen or the like may be introduced into the outer enclosure 1 and heating chamber 5. The atmosphere will enter the heating chamber 5 through passages (not shown) for that purpose or through spaces between the side and end walls and the bottom or car 9. During the heat-up portion of an annealing procedure and during soak times, the desired atmosphere will be heated during its passage about the heating elements within the heating chamber. Mention has already been made of heating elements located beneath the base plates 19 through 22. While, for purposes of clarity, they have not been shown, it will be understood that additional heating elements may be located along the inside surfaces of the heating chamber top and side walls.

To increase circulation within the heating chamber 5 and the outer enclosure 3, fan means generally indicated at 28 through 31 may be provided. The fan means may be mounted at the top (as shown) or at the side of the outer enclosure. Motor means for the fans 28 through 31 are located exteriorly of the outer enclosure as at 32 through 35, respectively. The fans 28 through 31 serve to draw atmosphere from the heating chamber 5 and circulate it within the outer enclosure 3 to re-enter the heating chamber. To further increase circulation of atmosphere within the heating chamber 5, the side walls of this chamber may be provided with automatically actuated bungs. Such bungs are illustrated in side wall 7 at 36 through 39. Finally, the atmosphere may exit the outer enclosure via pipe 40 controlled by valve 41. The pipe 40 may lead to recovery means for the atmosphere or to a flare stack, all as is well known in the art.

As indicated above, the car 9 normally operates as a single unit. However, it is made up of separate car sections 9*a* through 9*d* which may be detached from each other for purposes of repair. All of the car sections 9*a* through 9*d* are substantially the same. However, sections 9*a* and 9*d*, in the particular embodiment described, have one arrangement of heating elements thereon, while sections 9*b* and 9*c* are provided with another arrangement of heating elements. Since car sections 9*a* and 9*d* differ from each other primarily only in that car section 9*a* carries the front wall 12 of the heating chamber 5, a description of car section 9*a* will serve as a description of both of these sections.

Figure 2:
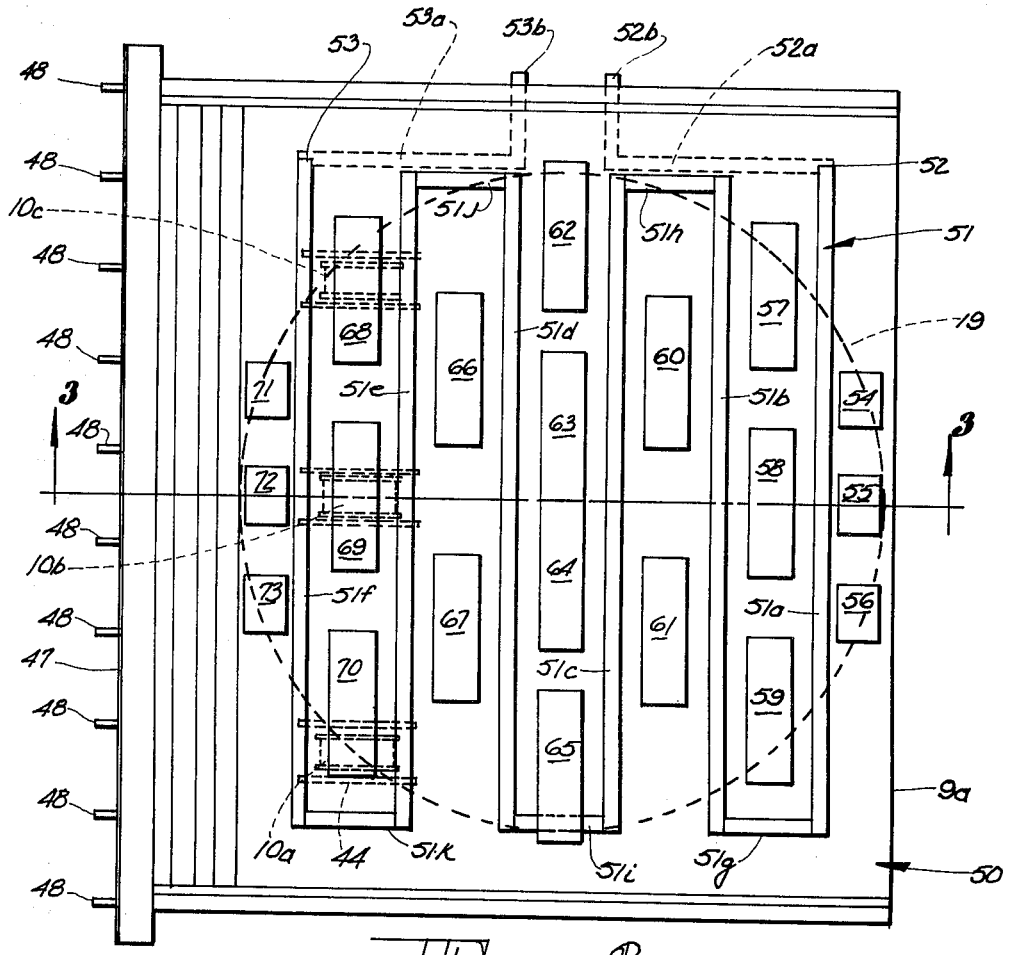
FIG. 2 is a plan view of a first section of the furnace car illustrating the supports of the present invention, together with the electrical heating elements and the base plate (in broken lines).
Figure 3:
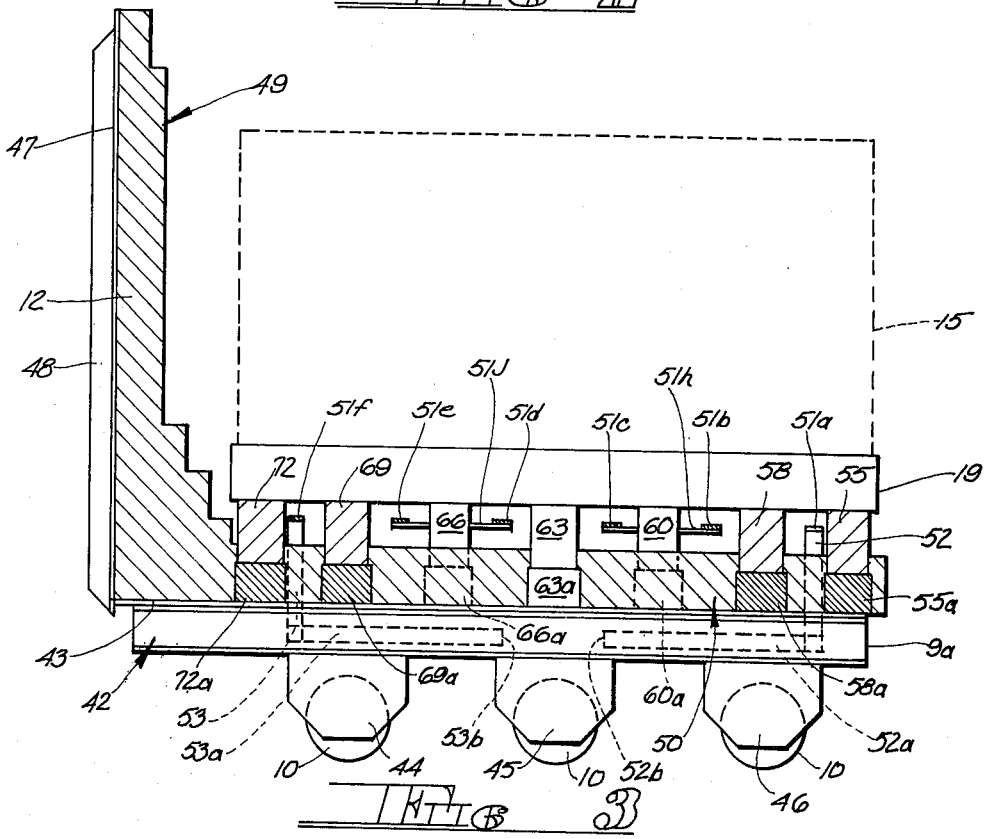
FIG. 3 is a cross sectional view taken along section line 3—3 of FIG. 2 and illustrating a coil in broken lines resting upon the base plate.

Reference is made to FIGS. 2 and 3 wherein car section 9*a* is shown and wherein like parts have been given like index numerals. The section 9*a* comprises a horizontally oriented framework generally indicated at 42 (FIG. 3) supporting an upper metallic surface 43. Means, partially shown at 44, 45 and 46 depend downwardly from the framework 42 and support sets of three wheels 10. Only one wheel of each set is illustrated in FIG. 3. In FIG. 2, the wheels of the forwardmost set are shown in broken lines at 10*a* through 10*c*.

The forwardmost end of the car supports the front wall 12 of the heating chamber. As shown in FIGS. 2 and 3, the front wall comprises a vertical metallic wall 47 provided with a plurality of braces 48. The metallic wall 47 is covered on its inside surface with ceramic fiber refractory material, such as high purity KAOWOOL (mentioned above), generally indicated at 49. As is most clearly seen in FIG. 3, the upper surface 43 of the car frame 42 is similarly lined with the ceramic fiber refractory material (except where the supports are located) as is generally indicated at 50.

Spaced above the insulative lining 50 on the upper surface 43 of the car, there is a heating element (generally indicated at 51) of molybdenum or other appropriate material. The heating element 51 follows a sinuous path having portions 51*a* through 51*f* extending transversely of car section 9*a* and connecting portions 51*g* through 51*k* extending longitudinally of the car section and joining the transverse portions 51*a* through 51*f*. The ends 52 and 53 of the heating element 51 extend downwardly through the layer of ceramic fiber refractory material 50 to points within the car framework 42. The ends 52 and 53 have portions 52*a* and 53*a* extending longitudinally of the car section toward each other and terminate in portions 52*b* and 53*b* extending laterally to the exterior of the car section, to make contact with the electrical facilities of the furnace when the car is in place within the outer enclosure 1.

The supports of the present invention to maintain the base plate 19 spaced upwardly of the ceramic fiber refractory material 50 by a distance sufficient to accommodate the heating element 51 comprise blocks of refractory material. While any refractory material having the requisite strength and temperature resistance may be used, excellent results have been achieved through the use of cast blocks of alumina. High alumina castable refractories manufactured by The Wahl Refractory Products Company of Fremont, Ohio, under the trademarks WAL-CAST-TA and WIRE-N-CAST are exemplary.

In FIG. 2, the arrangement of the supports of the present invention is most clearly shown. In this figure the base plate 19 is illustrated as comprising a disc-like element of stainless steel having a diameter only slightly greater than the coil 15 (see FIGS. 1 and 3) supported thereby. For purposes of clarity, the coil 15 is not shown in FIG. 2 and the base plate 19 is shown in broken lines.

The supports of the present invention are illustrated at 54 through 73 in FIG. 2. Supports 54 through 56 are located under that much of the base plate 19 extending beyond heating element portion 51*a*. Similarly, supports 71 through 73 are located beneath that much of the base plate extending beyond heating element portion 51*f*. It will be noted that these supports 54 through 56 and 71 through 73 are of equal length and width and are shorter than the remainder of the supports 57 through 70. All of the supports may have substantially the same width.

The remaining supports 57 through 70 are arranged in a pattern whereby three supports 57 through 59 are located between heating element portions 51*a* and 51*b*. Similarly, three supports 68 through 70 are located between element portions 51*e* and 51*f*. Pairs of support elements 60–61 and 66–67 are arranged between heating element portions 51*b* and 51*c* and heating element portions 51*d* and 51*e*, respectively. At the widest part of the base plate, transversely of the car, four supports 62 through 65 are used. All of the supports 57 through 70 may have the same length dimension and all of them are so arranged as to be equidistant from the adjacent heating element portions with their long axes parallel to the adjacent heating element portions.

While each of the supports 54 through 73 may constitute a single cast block of refractory material having a bottom surface resting upon the upper surface 43 of the frame 42 of the car section and an upper surface supporting the base plate 19, it has been found more convenient to have each support comprise a pair of blocks, one above the other. This is clearly shown in FIG. 3 wherein support blocks 55, 58, 60, 63, 66, 69 and 72 are each illustrated as resting upon an additional support block 55*a*, 58*a*, 60*a*, 63*a*, 66*a*, 69*a* and 72*a*, respectively. The use of pairs of blocks, each pair constituting a support, provides another shear plane and minimizes the possibility of cracks. It also enables standarization of block sizes. Nevertheless, it will be understood that the block pairs 55–55*a*, 58–58*a*, 60–60*a*, 63–63*a*, 66–66*a*, 69–69*a* and 72–72*a* of FIG. 3 may each be considered as representing a single block structure.

Each of the lower support blocks has a length and width equal to or slightly greater than the length and width of the upper support block resting thereon. Each of the lower support blocks may be slightly shorter in height than the support block resting thereon, but the total height of each upper and lower support block is the same and is such as to maintain the base plate 19 at the desired height from the upper surface 43 of the car 9*a*. All of the two-block supports being of the same height, it will be understood that the base plate 19 will be horizontal and in parallel spaced relationship with the horizontal upper surface 43 of the car section. As illustrated in FIG. 3, each of the lower support blocks may be of a height slightly less than the total height of the ceramic fiber refractory material 50.

Figure 4:
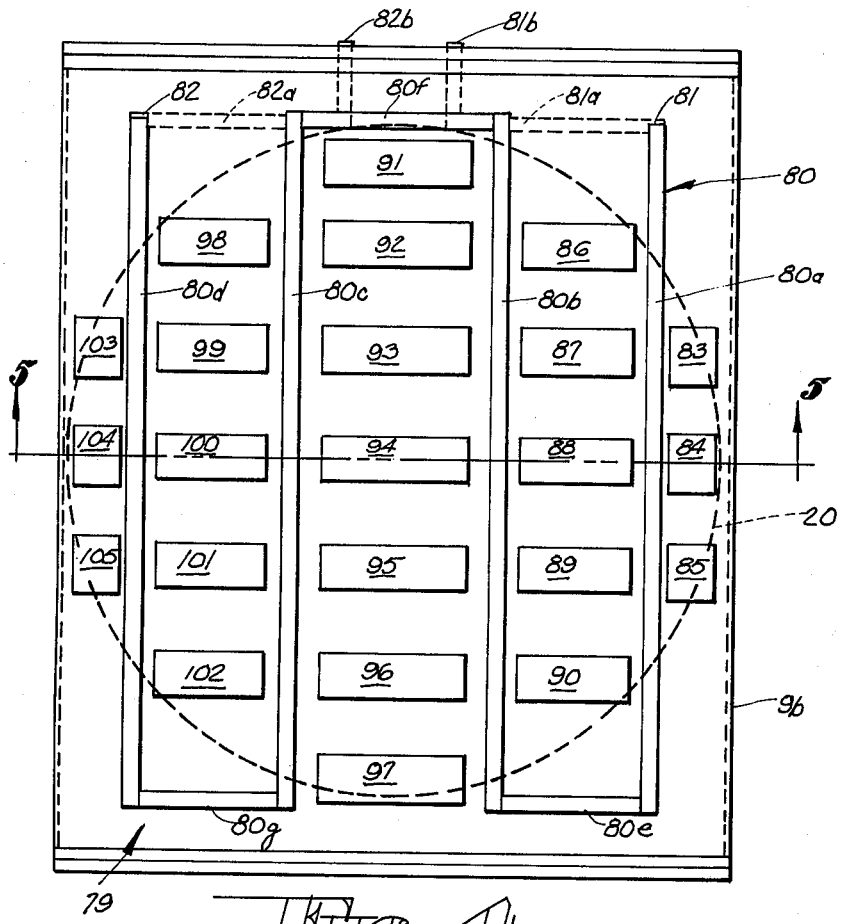
FIG. 4 is a plan view of another section of the furnace car, illustrating an alternate arrangement of the support means of the present invention, together with the heating elements and the base plate (in broken lines).
Figure 5:
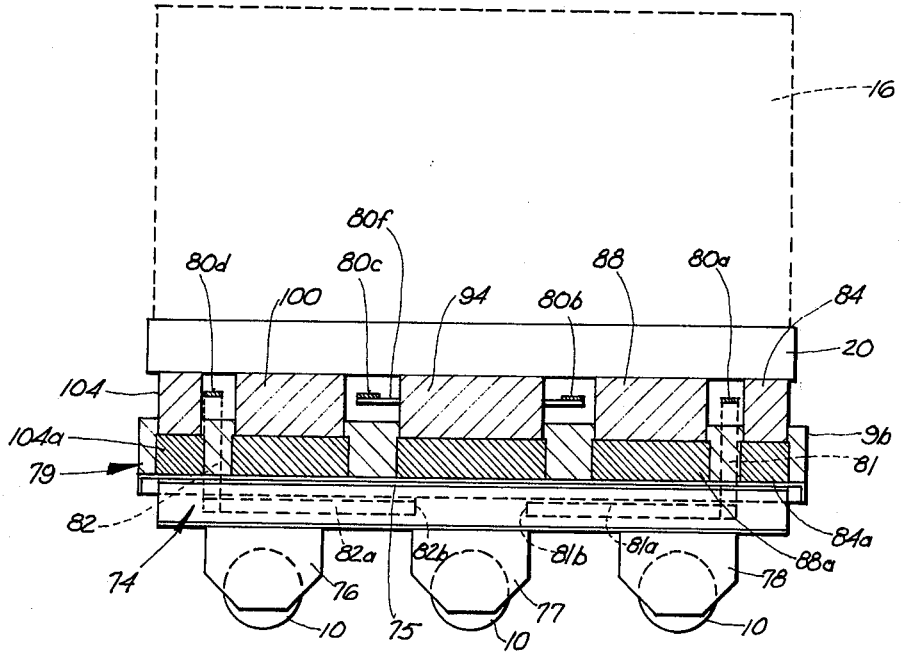
FIG. 5 is a cross sectional view taken along section line 5—5 of FIG. 4 of the car and showing a coil in broken lines resting upon the base plate.

FIGS. 4 and 5 illustrate car section 9*b* which, as indicated above, may be substantially identical to car section 9*c*. Again, like parts have been given like index numerals in FIGS. 4 and 5.

Car section 9*b* is similar to car section 9*a* and comprises a metallic framework generally indicated at 74 having an upper surface 75. Extending downwardly from the framework there are a plurality of means, some of which are shown at 76 through 78 supporting sets of wheels, one wheel of each set being shown at 10.

As in the case of car section 9*a*, the upper surface 75 of car section 9*b* is provided with a covering of ceramic fiber refractory material generally indicated at 79. Mounted above the material 79, by means of suitable support hangers (not shown), there is an electrical heating element generally indicated at 80. The heating element 80 is made up of a plurality of portions 80*a* through 80*d* extending transversely of the car and additional portions 80*e* through 80*g* connecting the first named portions. As in the case of car section 9*a*, the ends 81 and 82 of the heating element 80 extend down through the layer of ceramic fiber refractory material 79 to a position below the upper surface 75 of frame 74. Here, the ends have portions 81a and 82*a*, respectively, extending longitudinally of the car and toward each other. The portions 81*a* and 82*a* terminate in laterally extending portions 81*b* and 82*b*, respectively, which make contact with the electrical facilites of the furnace when car section 9*b* is located fully within the outer enclosure 1.

The base plate 20 is shown in full lines in FIG. 5 and in broken lines in FIG. 4. In FIG. 5 the metallic coil 16 is illustrated in broken lines mounted upon the base plate 20.

As will be evident from FIG. 4, the primary difference between the car section 9*b* and the previously described car section 9*a* lies in the fact that there are fewer heating element portions extending transversely of the car section. As a consequence, these heating element portions are spaced from each other by a greater distance.

These supports are shown in FIG. 4 at 80 through 105. The supports 83 through 85 are located under that portion of base plate 20 extending beyond heating element portion 80a. Similarly, supports 103 through 105 are arranged beneath that portion of base plate 20 extending beyond heating element portion 80*b*. The supports 83 through 85 and 103 through 105 may be substantially identical to supports 54 through 56 and 71 through 73 of FIG. 2.

Five supports 86 through 90 extend between heating element sections 80*a* and 80*b*. Similarly, five supports 98 through 102 are located between heating element portions 80*c* and 80*d*. At the widest portion of the base plate 20, transversely of car section 9*b*, seven supports 91 through 97 are placed between heating element portions 80*b* and 80*c*. In this arrangement, it will be noted that supports 86 through 102 have their long axes extending longitudinally of the car section, rather than transversely of the car section as shown in FIG. 2. This longitudinal orientation is permitted by virtue of the greater distance between the transversely extending portions of heating element 80. Further, it will be noted that supports 91 through 97 may be slightly longer than supports 86 through 90 and 98 through 102.

Again, the supports 83 through 105 may each constitute a single refractory block extending from the upper surface 75 of the car to the underside of the base plate 20. As indicated with respect to car section 9*a*, however, it has been found more convenient to make each support in the form of a pair of refractory blocks, one resting upon the other. To this end, blocks 84, 88, 94, 100 and 104 (shown in FIG. 5) are illustrated as resting upon lower refractory block elements 84*a*, 88*a*, 94*a*, 100*a* and 104*a*, respectively. These lower blocks may be substantially identical to the lower blocks shown in FIG. 3 and described above.

Figure 6:
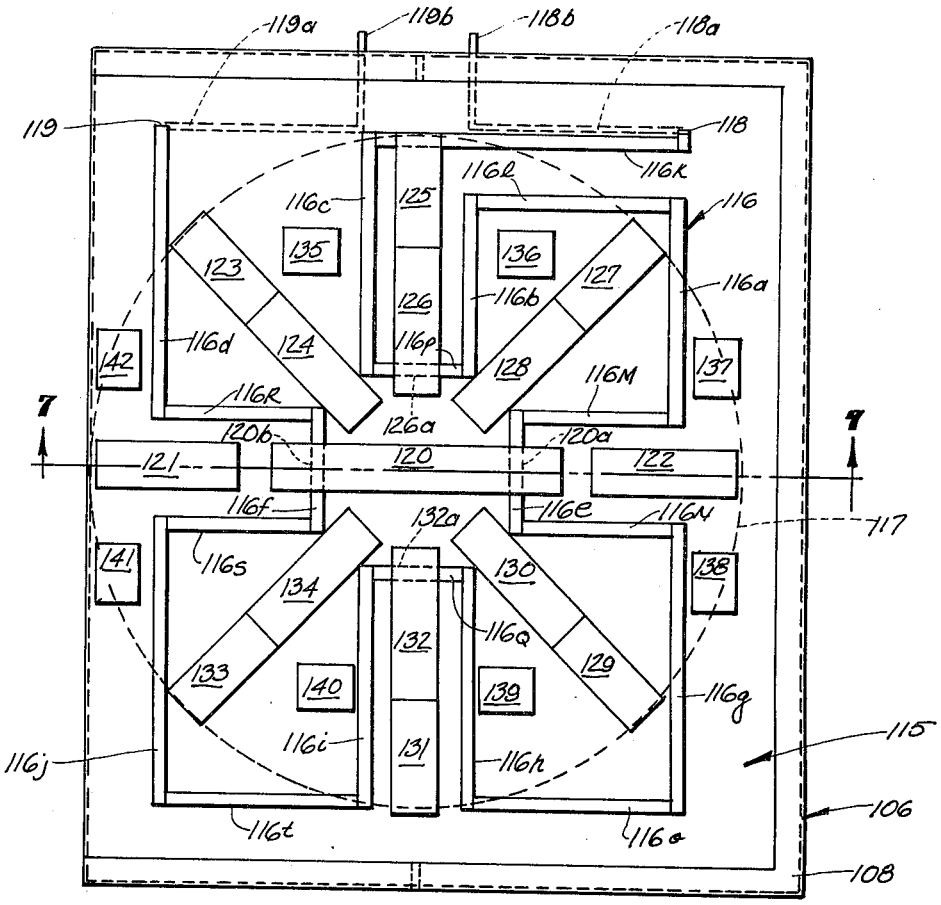
FIG. 6 is a plan view of another furnace car section illustrating yet another arrangement of the support means of the present invention, together with the heating elements and the base plate (in broken lines).
Figure 7:
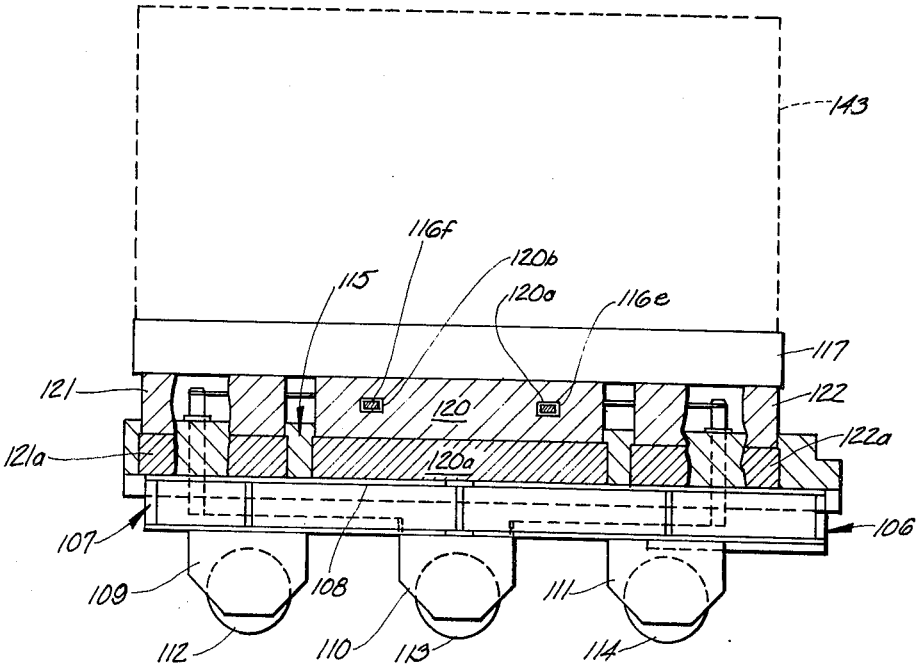
FIG. 7 is a cross sectional view taken along section line 7—7 of FIG. 6 and illustrating a coil in broken lines resting upon the base plate.

FIGS. 6 and 7 illustrate a car section generally indicated at 106 bearing a modified support arrangement. The car section 106, itself, may be similar to any of the car sections described above and one or more such car sections may be used to make up the car 9 of FIG. 1.

As in the case of the previously described car sections, car section 106 comprises a metallic framework generally indicated at 107 supporting an upper surface 108. Extending downwardly from the framework 107 there are a plurality of means, some of which are shown at 109 through 111 for supporting sets of wheels. One wheel of each set is illustrated in FIG. 7 at 112 through 114.

As with the previous car sections, the upper surface 108 of car section 106 is provided with a covering of ceramic fiber refractory material generally indicated at 115. Mounted above the fiber refractory material 115, by means of suitable support hangers (not shown), there is an electrical heating element generally indicated at 116. The heating element 116 is made up of a plurality of portions 116a through 116j extending transversely of the car and additional portions 116k through 116t extending longitudinally of the car and connecting the first named portions. As will be most evident from FIG. 6, the arrangement of the portions of heating element 116 is such as to form a series of substantially rectangular configurations beneath base plate 117 shown in broken lines in FIG. 6. The ends 118 and 119 of heating element 116 extend down through the layer of ceramic fiber refractory material 115 to a position below the upper surface 108 of the frame 107. Here, the ends have portions 118*a* and 119*a*, respectively, extending longitudinally of the car and toward each other. The portions 118*a* and 119*a* terminate in laterally extending portions 118*b* and 119*b*, respectively, which make contact with the electrical facilities of the furnace when car section 106 is located within the outer enclosure 1.

The particular arrangement of the portions or segments of heating element 116 permit the provision of a plurality of supports, arranged radially beneath the base plate 117. Centrally of base plate 117 there is a large support 120 extending longitudinally of the car. Spaced from either end of the support 120 there are additional supports 121 and 122. The remainder of the radially arranged supports may be made up of single long supports or of pairs of supports in end-to-end relationship. For purposes of an exemplary showing, the remaining radially arranged supports are shown as being pairs 123–124, 125–126, 127–128, 129–130, 131–132 and 133–134. It will further be noted that the outermost block of each support pair (123, 125, 127, 129, 131 and 133) is slightly shorter than the innermost block of each support pair (124, 126, 128, 130, 132 and 134).

Interspersed between the radially arranged supports there are smaller supports shown at 135 through 142. In this arrangement of supports, it will be noted that portions or segments 116*e* and 116*f* of the heating element 116 pass through slots 120*a* and 120*b*, respectively, in the support 120. Similarly, heating element segment 116p passes through a transverse slot 126*a* in support 126 while heating element segment 116*q* passes through a transverse slot 132*a* in support 132.

Again, the supports 120 through 142 may each constitute a single refractory block extending from the upper surface 108 of car section 106 to the underside of base plate 117. As indicated with respect to the previously described car sections, however, it has been found more convenient to make each support in the form of a pair of refractory blocks, one resting upon the other. To this end, blocks 120, 121 and 122 are shown in FIG. 7 as resting upon lower refractory block elements 120*a*, 121*a* and 122*a*, respectively.

In FIG. 7 the base plate 117 is illustrated in full lines. A coil 143 is shown in broken lines resting upon base plate 117. Advantages of the support arrangement illustrated in FIGS. 6 and 7 lie in the fact that the supports are aligned in the direction of extension and contraction of base plate 117. Furthermore, an excellent uniform distribution of supports beneath base plate 117 and coil 143 is achieved.

It has been found that supports in the form of cast blocks of refractory material such as alumina or the like can be made with very smooth surfaces to give excellent full surface contact between the supports and the upper surfaces of the car sections and the lower surfaces of the base plates. The refractory blocks prevent the car itself from acting as a heat sink with respect to the base plates it carries and even with the temperatures and weights involved, the stainless steel or ingot iron base plates do not distort or warp. This, in turn, prevents distortion of the coils being annealed. It will be evident to one skilled in the art that the supports of the present invention may be easily and inexpensively manufactured and may be readily arranged to afford maximum support for the base plates, reducing unsupported spans of the base plates to a minimum. At the same time, the supports may be so arranged as to permit adequate passage of atmosphere around and about the base plates and the heating element thereunder.

Modifications may be made in the invention without departing from the spirit of it.

The embodiments of the invention in which an exclusive property or privilege is claimed are defined as follows:

1. In an annealing furance of the type comprising an outer enclosure surrounding an insulated heating chamber and wherein the bottom of said heating chamber comprises a metallic coil-carrying car mounting on its upper surface at least one base plate upon which a coil of metal to be anealed is located, said car having an electrical heating element above its upper surface and beneath said base plate, improved supports for said base plate on said upper surface of said car, each of said supports comprising at least one block of refractory material mounted on said upper surface of said car and upon which said base plate rests, said supports being so arranged on said upper surface of said car as to afford maximum support for said base plate whereby to prevent warping of said base plate and distortion of said coil thereon during an annealing cycle, said supports being of such height as to accommodate said heating element between said upper surface of said car and said base plate in spaced relationship to both and to permit circulation of an atmosphere about said heating element.

2. The structure claimed in claim 1 wherein each of said supports comprises a pair of blocks of refractory material, one mounted on top of the other.

3. The structure claimed in claim 1 wherein said upper surface of said car is provided with a layer of refractory ceramic fiber material around and about said supports, said supports extending above said refractory ceramic fiber layer by a distance sufficient to accommodate said heating element between said refractory ceramic fiber layer and said base plate and to permit circulation of an atmosphere about said heating element.

4. The structure claimed in claim 1 wherein said heating element comprises a horizontal member following a sinuous path having first elongated portions extending transversely of said car and second shorter portions extending longitudinally of said car and joining adjacent ends of said first portions.

5. The structure claimed in claim 1 wherein said blocks comprise cast alumina.

6. The structure claimed in claim 1 wherein certain at least of said supports are so arranged as to have their long horizontal axes aligned radially with respect to said coil when said coil is located on said base plate.

7. The structure claimed in claim 2 wherein said blocks comprise cast alumina.

8. The structure claimed in claim 4 wherein said upper surface of said car is provided with a layer of refractory ceramic fiber material around and about said supports, said supports extending above said refractory ceramic fiber layer by a distance sufficient to accommodate said heating element between said refractory ceramic fiber layer and said base plate and to permit circulation of an atmosphere about said heating element.

9. The structure claimed in claim 4 wherein some of said block supports are located between that one of said first elongated portions of said heating element nearest one end of said car and said one end of said car with their long axes parallel to said last mentioned heating element portion, others of said supports being located between that one of said first elongated portions of said heating element nearest the other end of said car and said other end of said car with their long axes parallel to said last mentioned heating element portion, the remainder of said supports being located between and evenly spaced from adjacent ones of said first elongated portions of said heating element with their long axes parallel to said last mentioned heating element portions.

10. The structure claimed in claim 4 wherein some of said block supports are located between that one of said first elongated portions of said heating element nearest one end of said car and said one end of said car with their long axes parallel to said last mentioned heating element portion, others of said supports being located between that one of said first elongated portions of said heating element nearest the other end of said car and said other end of said car with their long axes parallel to said last mentioned heating element portion, the remainder of said supports being located between and evenly spaced from adjacent ones of said first elongated portions of said heating element with their long axes extending longitudinally of said car.

11. The structure claimed in claim 6 wherein said upper surface of said car is provided with a layer of refractory ceramic fiber material around and about said supports, said supports extending above said refractory ceramic fiber layer by a distance sufficient to accommodate said heating element between said refractory ceramic fiber layer and said base plate and to permit circulation of an atmosphere about said heating element.

12. The structure claimed in claim 6 wherein each of said supports comprises a pair of blocks of refractory material, one mounted on top of the other.

13. The structure claimed in claim 9 wherein said upper surface of said car is provided with a layer of refractory ceramic fiber material around and about said supports, said supports extending above said refractory ceramic fiber layer by a distance sufficient to accommodate said heating element between said refractory ceramic fiber layer and said base plate and to permit circulation of an atmosphere about said heating element.

14. The structure claimed in claim 9 wherein each of said supports comprises a pair of blocks of refractory material, one mounted on top of the other.

15. The structure claimed in claim 10 wherein said upper surface of said car is provided with a layer of refractory ceramic material around and about said supports, said supports extending above said refractory material by a distance sufficient to accommodate said heating element between said refractory ceramic layer and said base plate and to permit circulation of an atmosphere about said heating element.

16. The structure claimed in claim 10 wherein each of said supports comprises a pair of blocks of refractory material, one mounted on top of the other.

17. The structure claimed in claim 12 wherein said blocks comprise cast alumina.

18. The structure claimed in claim 14 wherein said blocks comprise cast alumina.

19. The structure claimed in claim 16 wherein said blocks comprise cast alumina.

* * * * *